US011407132B2

(12) United States Patent
Jaber

(10) Patent No.: US 11,407,132 B2
(45) Date of Patent: Aug. 9, 2022

(54) POWERED HAIR CLIPPERS WITH BLADE ASSEMBLIES INCLUDING BLADE SUSPENSION ASSEMBLIES

(71) Applicant: CareFusion 2200, Inc., San Diego, CA (US)

(72) Inventor: Anas Jaber, Schaumburg, IL (US)

(73) Assignee: CareFusion 2200, Inc., San Diego, CA (US)

( * ) Notice: Subject to any disclaimer, the term of this patent is extended or adjusted under 35 U.S.C. 154(b) by 169 days.

(21) Appl. No.: 16/743,378

(22) Filed: Jan. 15, 2020

(65) Prior Publication Data

US 2020/0223076 A1 Jul. 16, 2020

Related U.S. Application Data

(60) Provisional application No. 62/792,591, filed on Jan. 15, 2019.

(51) Int. Cl.
*B26B 19/38* (2006.01)

(52) U.S. Cl.
CPC ..... *B26B 19/3846* (2013.01); *B26B 19/3853* (2013.01)

(58) Field of Classification Search
None
See application file for complete search history.

(56) References Cited

U.S. PATENT DOCUMENTS 2,291,439 A 7/1942 Andis
3,871,077 A 3/1975 Nissen et al.
5,054,199 A * 10/1991 Ogawa ..... B26B 19/102 30/34.1
5,604,986 A * 2/1997 Masuda ..... B26B 19/06 30/179
8,136,249 B2 * 3/2012 Shiba ..... B26B 19/3853 30/43.92
9,427,880 B2 * 8/2016 Carlucci ..... B26B 19/3846
9,815,215 B2 11/2017 Uit De Bulten et al.
10,384,358 B2 * 8/2019 Nayna ..... B26B 19/063
10,391,647 B2 * 8/2019 Phoon ..... B26B 19/42
(Continued)

FOREIGN PATENT DOCUMENTS

DE 102011008314 A1 7/2012
EP 1295686 A1 3/2003

OTHER PUBLICATIONS

International Search Report of PCT/US2020/013635 dated May 20, 2020.

(Continued)

*Primary Examiner* — Hwei-Siu C Payer
(74) *Attorney, Agent, or Firm* — Dinsmore & Shohl LLP

(57) ABSTRACT

A hair clipper includes a clipper body comprising a motor and a blade assembly connected to the clipper body such that the motor moves a blade of the blade assembly during operation. The blade assembly comprising a blade housing and the blade that extends outwardly from an opening in the housing and a linkage that is connected to the blade and biases the blade toward a fully extended configuration. Wherein, upon application of a force against the blade during use that is above a preselected threshold, the blade assembly includes a retracted configuration wherein the blade retracts into the blade housing using the linkage.

20 Claims, 5 Drawing Sheets

(56) References Cited

U.S. PATENT DOCUMENTS

| | | | | |
|---|---|---|---|---|
| 2009/0106981 | A1 | 4/2009 | Palmer et al. | |
| 2012/0110859 | A1 | 5/2012 | Kammer | |
| 2014/0053412 | A1 | 2/2014 | Carlucci et al. | |
| 2016/0039102 | A1* | 2/2016 | Shimizu | B26B 19/102 30/34.1 |
| 2016/0129601 | A1 | 5/2016 | Kammer et al. | |
| 2016/0129602 | A1 | 5/2016 | Mintz et al. | |
| 2016/0361826 | A1 | 12/2016 | Musallam | |
| 2020/0223076 | A1* | 7/2020 | Jaber | B26B 19/3853 |

OTHER PUBLICATIONS

International Search Report of PCT/US2020/013640 dated Apr. 20, 2020.

International Search Report of PCT/US2020/013636 dated Mar. 30, 2020.

* cited by examiner

POWERED HAIR CLIPPERS WITH BLADE ASSEMBLIES INCLUDING BLADE SUSPENSION ASSEMBLIES

CROSS-REFERENCE

This application claims the benefit of and priority to U.S. Provisional Patent Application No. 62/792,591, titled Powered Hair Clippers with Blade Assemblies Including Blade Suspension Assemblies, filed Jan. 15, 2019, the details of which are hereby incorporated by reference.

TECHNICAL FIELD

The present specification generally relates to powered hair clippers and, more specifically, to powered hair clippers with blade assemblies including blade suspension assemblies that can be used to extend and retract blades based on an applied force or lack thereof on the blades.

BACKGROUND

Hair clippers are provided for hair removal. Some hair clippers may be suitable for everyday use and some hair clippers may be suitable for more specialized uses, such as in preparation for a medical procedure. The hair clippers generally include a blade assembly that includes a housing and a blade that extends outwardly from the housing. The housing may include a surface that glides along the skin as hair is being removed using the blade. A user typically applies a force against the skin during a hair removal operation. Application of too much force against the skin using the blade and/or operation at too steep of an angle relative to the skin can cause nicking of the skin.

SUMMARY

In one embodiment, a hair clipper includes a clipper body comprising a motor and a blade assembly connected to the clipper body such that the motor moves a blade of the blade assembly during operation. The blade assembly comprising a blade housing and the blade that extends outwardly from an opening in the housing and a linkage that is connected to the blade and biases the blade toward a fully extended configuration. Wherein, upon application of a force against the blade during use that is above a preselected threshold, the blade assembly includes a retracted configuration wherein the blade retracts into the blade housing using the linkage.

In another embodiment, a blade assembly connects to a clipper body of a hair clipper such that a motor moves a blade of the blade assembly during operation. The blade assembly includes a blade housing and the blade that extends outwardly from an opening in the housing and a linkage that is connected to the blade and biases the blade toward a fully extended configuration. Wherein, upon application of a force against the blade during use that is above a preselected threshold, the blade assembly includes a retracted configuration wherein the blade retracts into the blade housing using the linkage.

In another embodiment, a method of using a hair clipper for hair removal from a skin area of a patient is provided. The method includes coupling a blade assembly to a clipper body of the hair clipper. The blade assembly includes a blade housing and the blade that extends outwardly from an opening in the housing and a linkage that is connected to the blade and biases the blade toward a fully extended configuration. Wherein, upon application of a force against the blade during use that is above a preselected threshold, the blade assembly includes a retracted configuration wherein the blade retracts into the blade housing using the linkage. A guide surface of the blade assembly is faced toward the skin area. The blade assembly is operated to remove hair from the skin area. A blade of the blade assembly is retracted into the blade housing using a linkage if a force against the blade during use is above a preselected threshold.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein are generally directed to powered hair clippers with blade assemblies including blade assemblies that are provided with a blade suspension assembly that allows blades to be retracted and extended depending on force against the skin and angle of the blades. The hair clippers include a clipper body and the blade assembly that is connected to a motor that is located in the blade body. The motor is used to oscillate a first blade of the blade assembly relative to a second blade of the blade assembly in order to cut hair as the blade assembly is moved across the skin. The blade assembly includes a blade housing that includes a guide surface that is used to guide the blade assembly along a skin surface. While the guide surface can help a user guide the blade assemblies, there may be occasions where an increased force and cutting angle are applied through the blades against the skin. The blade suspension assembly can retract the blades into the blade housing in order to reduce the force and contact with the skin depending on an amount of applied force.

Figure 1:
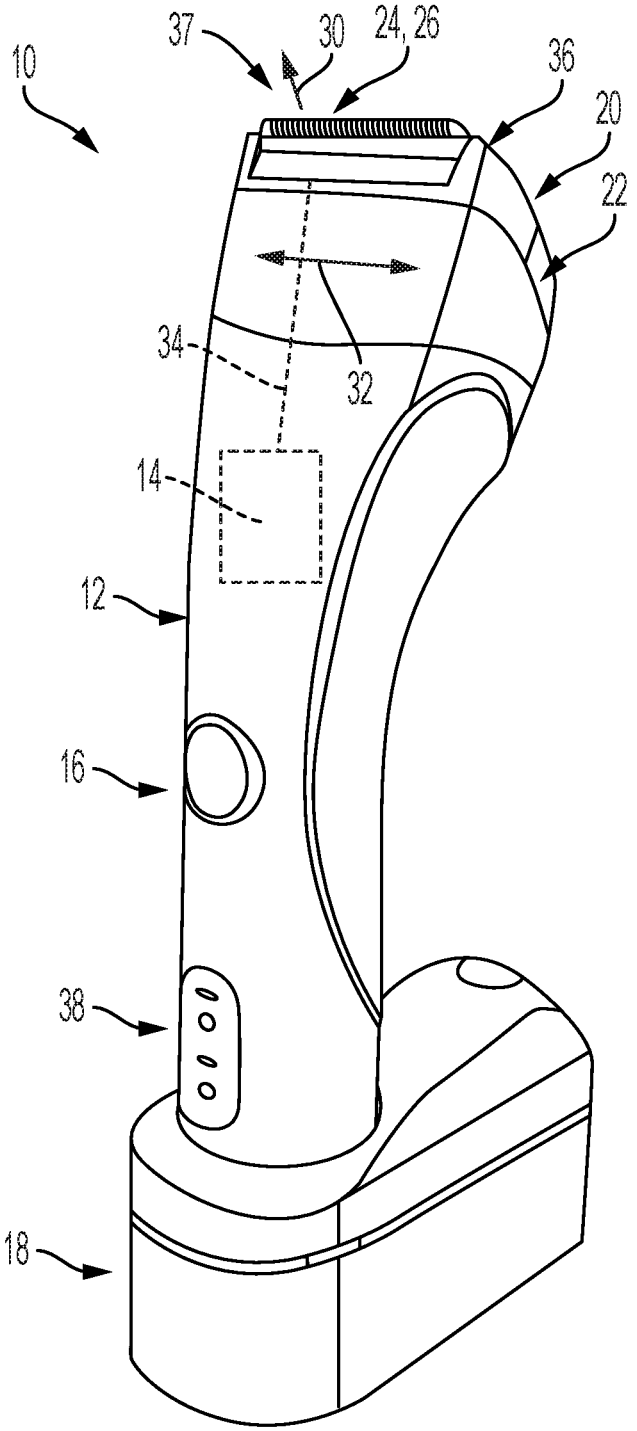
FIG. 1 is a perspective view of a hair clipper with charging station, according to one or more embodiments shown and described herein.

Referring to FIG. 1, a hair clipper 10 includes a clipper body 12 that provides a housing for components of the hair clipper, such as a motor (e.g., a rotary motor), which is illustrated schematically by element 14, and a user interface 16 that is used to control operation of the hair clipper 10. The clipper body 12 may further include a rechargeable battery (e.g., a lithium battery) that can be recharged using a charging station 18.

A blade assembly 20 is connected to the clipper body 12. The blade assembly 20 includes a blade housing 22 and a first blade 24 that extends outwardly from the blade housing 22. In some embodiments, the blade assembly 20 may be removable from the clipper body 12 and be disposable. In other embodiments, the blade assembly 20 may be a permanent part of the clipper body 12 and may not be intended to be removable without damage to the hair clipper 10. For removable blade assemblies 20, there may different blade assembly types, such as general purpose blade assembly for body hair, a neuro blade assembly for scalp and other thick, course hair and a sensitive blade assembly for perineal/sensitive areas. The blade assemblies may be intended for a single use.

The blade assembly 20 includes the first blade 24 and a second blade 26 that both extend outwardly from a corner of the blade housing 22 defining a blade cutting direction in the direction of arrow 30. The blades 24 and 26 have teeth that provide a comb-like shape across a width of the blades 24 and 26 defining a width direction in the direction of arrow 32 that is perpendicular to the blade cutting direction. The motor 14 reciprocates the first blade 24 in the width direction relative to the second blade 26 via a linkage 34 in order to cut hair located between the teeth.

The blade housing 22 includes a guide surface 36 that is located at a skin engagement end 37 of the hair clipper 10. The guide surface 36 faces the skin during a trimming operation. As can be seen, the guide surface 36 defines a plane that is substantially parallel with the cutting direction 30. In some embodiments, the cutting direction 30 and the guide surface 36 may be at an angle (e.g., between about 135 and about 145 degrees) that is oblique to a central axis that passes through a base portion 38 of the clipper body 12 (FIG. 1).

Figure 2:
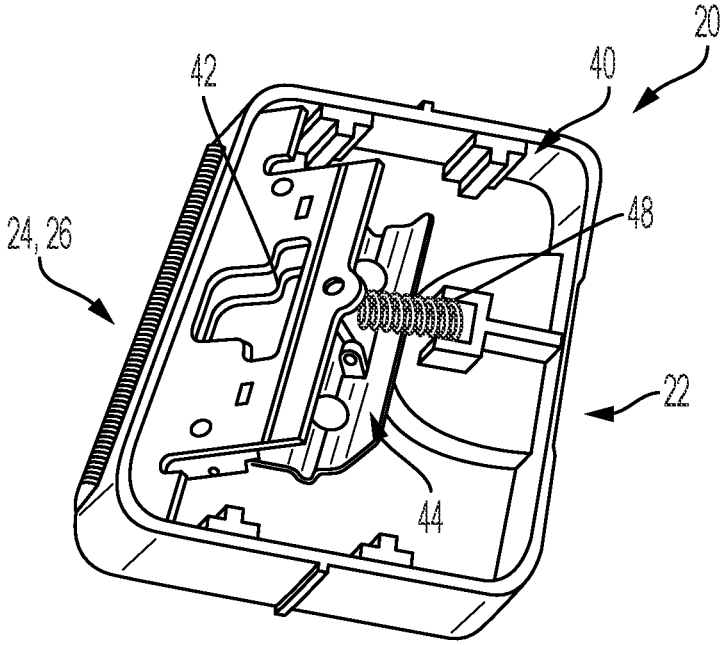
FIG. 2 is a perspective, schematic view of a blade assembly for use with the hair clipper of FIG. 1, according to one or more embodiments shown and described herein.

Referring to FIG. 2, a schematic illustration of a body attachment side 40 of the blade assembly 20 is illustrated. The blade assembly 20 includes the first blade 24 and the second blade 26. The first blade 24 is connected to a guide plate 42 that connects to the linkage 34 (e.g., an eccentric shaft) that is rotated by the motor 14 to move the first blade 24 in the width direction. In this regard, the first blade 24 may be referred to as a moveable blade that moves in the widthwise direction relative to the second blade.

Figure 3:
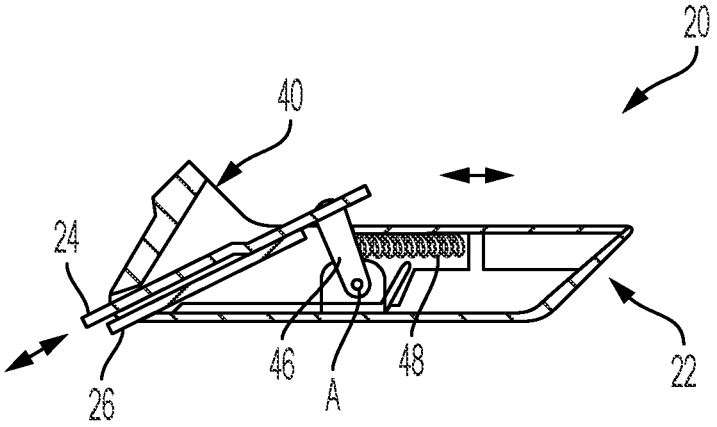
FIG. 3 is a side section view of the blade assembly of FIG. 2, according to one or more embodiments shown and described herein.
Figure 4:
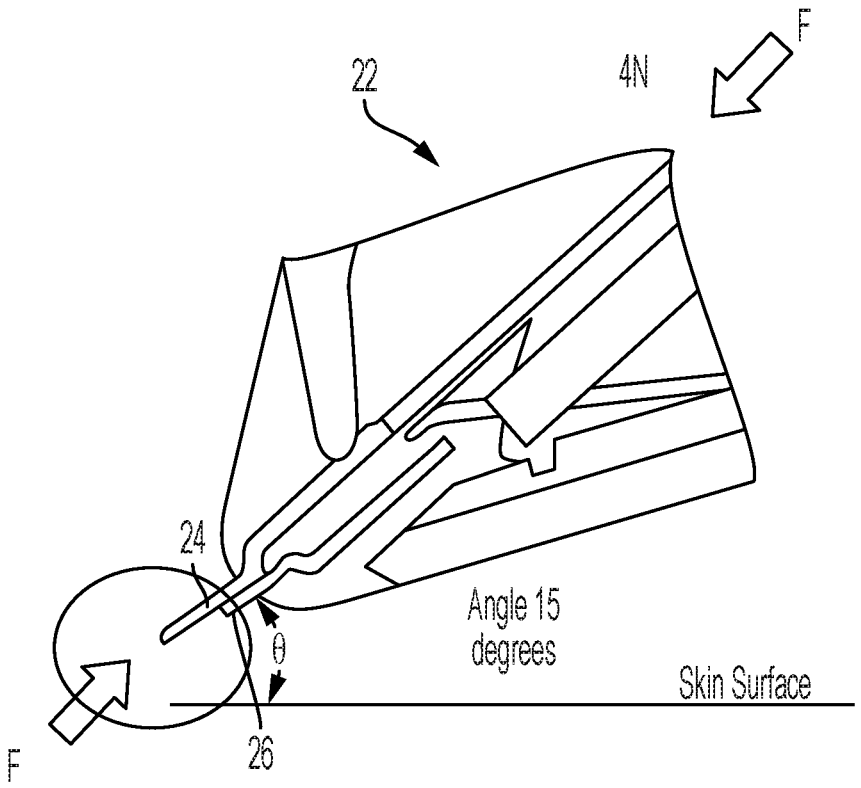
FIG. 4 is a side schematic section view of the blade assembly of FIG. 3 in an extended configuration, according to one or more embodiments shown and described herein.
Figure 5:
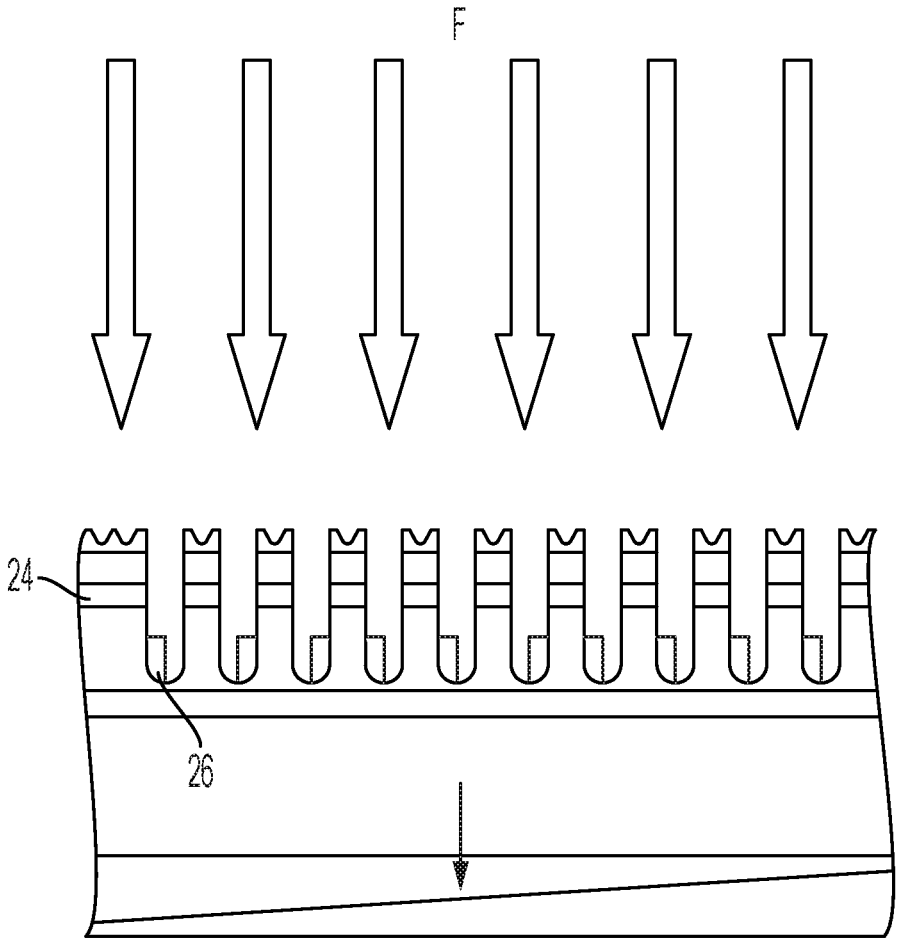
FIG. 5 is a schematic plan view of blades of the hair clipper of FIG. 1, according to one or more embodiments shown and described herein.
Figure 6:
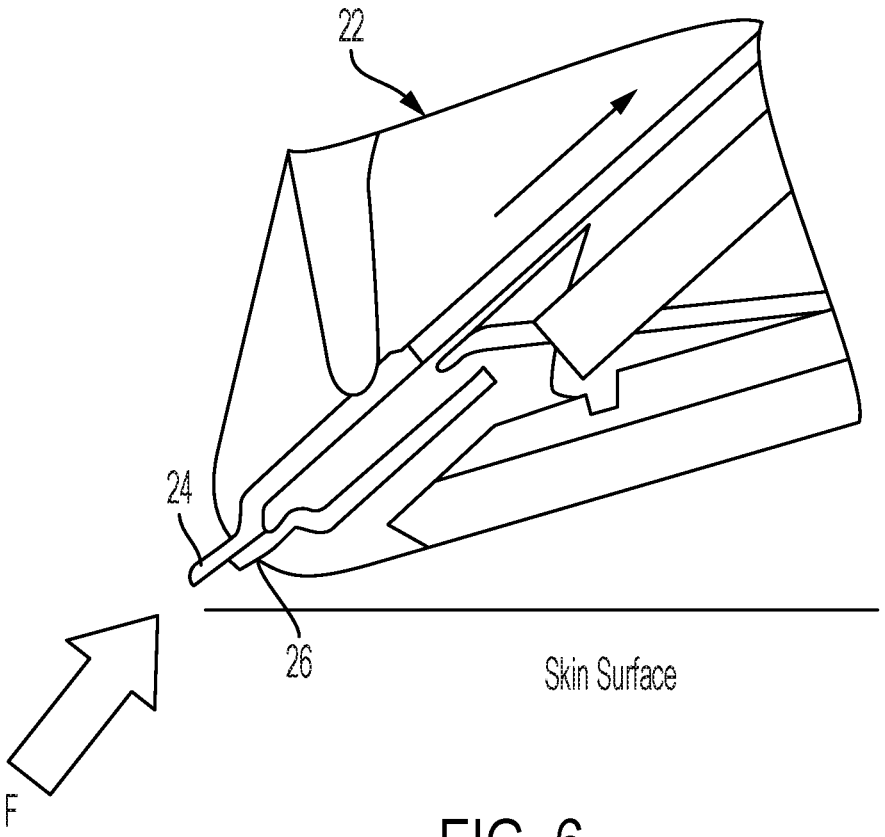
FIG. 6 is a side schematic section view of the blade assembly of FIG. 3 in retracted configuration, according to one or more embodiments shown and described herein.

Both blades 24 and 26 are connected to a linkage 44. The linkage 44 may include a pivot arm 46 that is connected to the blades 24 and 26. The pivot arm 46 can pivot about pivot axis A to allow for movement of the blades 24 and 26 into and out of the blade housing 22. A biasing member 48, such as a spring, may be provided that biases the pivot arm 46 and the blades 24 and 26 toward a fully extended position. Upon an application of force F (FIGS. 4-6) beyond a predetermined amount (e.g., at least about 3.5 N, such as 4N shown by FIG. 4), the biasing force of the biasing member 48 may be overcome, thereby causing the blades 24 and 26 to retract into the housing body 22, as represented by FIGS. 3-5. A skin contact angle θ (e.g., of between about 15 and about 45 degrees) may also affect whether the blades 24 and 26 retract from the fully extended position. The blades 24 and 26 may retract only partially or fully into the blade housing 22 depending on the force against the blades 24 and 26 and the skin contact angle θ.

A method of using the hair clipper for hair removal from a skin area of a patient may include coupling the blade assembly 20 to the clipper body 12 of the surgical clipper 10. The blade assembly 20 includes the blades 24 and 26 that have a fully extended configuration where an end of the blades 24 and 26 is located outside the blade housing 22 and a fully retracted configuration where the end of the blades is retracted inside the blade housing 22. The amount of blade retraction may depend on one or both of the force against the blades 24 and 26 and the skin contact angle θ. The blades 24 and 26 may return to their original, fully extended configuration once the force is removed and the contact angle θ is reduced.

As described herein, the body 12 of the surgical clipper 10 is configured to electronically operate the blade 24. The body 12 includes the enclosure housing an electrical motor and a battery, which battery is configured to be rechargeable through coupling of the body 12 to a charging adaptor 18. The body 12 of the surgical clipper 10 further may include a charge indicator configured to indicate a low battery level of the battery below a predefined threshold. The method may include triggering an alarm through the charge indicator of the low battery level, coupling the body to the charging adaptor, and recharging the battery. The alarm may be a visual, audio, or tactile alarm. Such a visual alarm may be an LED light that may, for example, red to indicate the low battery level.

For the purposes of describing and defining the present disclosure, it is noted that recitations herein of "at least one" component, element, etc., should not be used to create an inference that the alternative use of the articles "a" or "an" should be limited to a single component, element, etc.

It is noted that recitations herein of a component of the present disclosure being "configured" in a particular way, to embody a particular property, or to function in a particular manner, are structural recitations, as opposed to recitations of intended use. More specifically, the references herein to the manner in which a component is "configured" denotes an existing physical condition of the component and, as such, is to be taken as a definite recitation of the structural characteristics of the component.

For the purposes of describing and defining the present disclosure it is noted that the terms "substantially" and "approximately" and "about" are utilized herein to represent the inherent degree of uncertainty that may be attributed to any quantitative comparison, value, measurement, or other representation. The terms "substantially" and "approximately" and "about" are also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present disclosure, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A hair clipper comprising:

a clipper body comprising a motor; and a blade assembly connected to the clipper body such that the motor moves a blade of the blade assembly back and forth within a plane during operation, the blade assembly comprising a blade housing and the blade that extends outwardly from an opening in the housing and a linkage that is connected to the blade and biases the blade toward a fully extended configuration;

wherein, upon application of a force against the blade during use that is above a preselected threshold, the blade comprising a retracted configuration wherein the blade retracts in the plane into the blade housing using the linkage.

2. The hair clipper of claim 1 further comprising a spring that biases the linkage and the blade toward the fully extended configuration.

3. The hair clipper of claim 1, wherein the blade is a first blade, the blade assembly comprising a second blade, the motor moving the first blade relative to the second blade in a width direction perpendicular to a cutting direction of the blade assembly.

4. The hair clipper of claim 3, wherein the blade retracts into the blade housing in the cutting direction.

5. The hair clipper of claim 1, wherein the blade assembly is removably attached to the clipper body.

6. The hair clipper of claim 1, wherein the linkage comprises a pivot arm that is connected to the blade.

7. The hair clipper of claim 6, wherein the pivot arm is spring biased toward the fully extended configuration.

8. The hair clipper of claim 1, wherein the blade retracts into the blade housing at a cutting angle that is greater than 15 degrees from a skin surface which the blade contacts during use.

9. A blade assembly connectable to a clipper body of a hair clipper such that a motor moves a blade of the blade assembly back and forth within a plane during operation, the blade assembly comprising:

a blade housing and the blade that extends outwardly from an opening in the housing and a linkage that is connected to the blade and biases the blade toward a fully extended configuration;

wherein, upon application of a force against the blade during use that is above a preselected threshold, the blade comprising a retracted configuration wherein the blade retracts in the plane into the blade housing using the linkage.

10. The blade assembly of claim 9 further comprising a spring that biases the linkage and the blade toward the fully extended configuration.

11. The blade assembly of claim 9, wherein the blade is a first blade, the blade assembly comprising a second blade, the motor moving the first blade relative to the second blade in a width direction perpendicular to a cutting direction of the blade assembly.

12. The blade assembly of claim 11, wherein the blade retracts into the blade housing in the cutting direction.

13. The blade assembly of claim 9, wherein the blade assembly is attachable to the clipper body.

14. The blade assembly of claim 9, wherein the linkage comprises a pivot arm that is connected to the blade.

15. The blade assembly of claim 14, wherein the pivot arm is spring biased toward the fully extended configuration.

16. The blade assembly of claim 9, wherein the blade retracts into the blade housing at a cutting angle that is greater than 15 degrees from a skin surface which the blade contacts during use.

17. A method of using a hair clipper for hair removal from a skin area of a patient, the method comprising:

coupling a blade assembly to a clipper body of the hair clipper, the blade assembly comprising:

a blade that moves back and forth within a plane;

a blade housing and the blade that extends outwardly from an opening in the housing and a linkage that is connected to the blade and biases the blade toward a fully extended configuration;

the blade comprising a retracted configuration wherein the blade retracts in the plane into the blade housing using the linkage upon application of a force against the blade during use that is above a preselected threshold;

facing a guide surface of the blade assembly toward the skin area;

operating the blade assembly to remove hair from the skin area; and retracting the blade of the blade assembly into the blade housing using the linkage when the force against the blade during use is above the preselected threshold.

18. The method of claim 17 further comprising providing a spring for biasing the linkage and the blade toward the fully extended configuration.

19. The method of claim 17, wherein the blade is a first blade, the blade assembly comprising a second blade, wherein the method further comprises providing the hair clipper with a motor for moving the first blade relative to the second blade in a width direction perpendicular to a cutting direction of the blade assembly.

20. The method of claim 17, wherein the step of coupling comprises removably attaching the blade assembly to the clipper body.

* * * * *